US008564489B2

(12) United States Patent
Tabata et al.

(10) Patent No.: US 8,564,489 B2
(45) Date of Patent: Oct. 22, 2013

(54) GLASS ANTENNA AND WINDOW GLASS FOR VEHICLE

(71) Applicant: Asahi Glass Company, Limited, Tokyo (JP)

(72) Inventors: Koji Tabata, Tokyo (JP); Kiyoshi Oshima, Tokyo (JP); Yasuhiro Koga, Tokyo (JP); Kiyoshi Nobuoka, Tokyo (JP); Soutarou Kitade, Tokyo (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 13/666,730

(22) Filed: Nov. 1, 2012

(65) Prior Publication Data

US 2013/0057439 A1 Mar. 7, 2013

Related U.S. Application Data

(63) Continuation-in-part of application No. 12/801,567, filed on Jun. 15, 2010, now Pat. No. 8,330,664.

(30) Foreign Application Priority Data

Jun. 16, 2009 (JP) ..... P.2009-143614

(51) Int. Cl.
*H01Q 1/32* (2006.01)

(52) U.S. Cl.
USPC ..... 343/713

(58) Field of Classification Search
USPC ..... 343/711, 713
See application file for complete search history.

(56) References Cited

U.S. PATENT DOCUMENTS

| | | | | |
|---|---|---|---|---|
| 5,719,585 | A | 2/1998 | Tabata et al. | |
| 6,906,671 | B2 * | 6/2005 | Oka | 343/713 |
| 7,456,796 | B2 * | 11/2008 | Nagayama et al. | 343/713 |
| 7,511,676 | B2 | 3/2009 | Noda | |
| 8,040,285 | B2 | 10/2011 | Shimo et al. | |
| 2011/0043419 | A1 | 2/2011 | Noguchi et al. | |

FOREIGN PATENT DOCUMENTS

| | | |
|---|---|---|
| EP | 2 051 326 A1 | 4/2009 |
| EP | 2 214 254 A1 | 8/2010 |
| JP | 06-021711 | 1/1994 |
| JP | 08-032337 | 2/1996 |
| JP | 10-013126 | 1/1998 |

OTHER PUBLICATIONS

EP Communication (European Search Report) in EP Appln No. 10006277.7 dated Sep. 30, 2010.
Notice of Allowance U.S. Appl. No. 12/801,567 dated Aug. 2, 2012.

* cited by examiner

*Primary Examiner* — Hoang V Nguyen
(74) *Attorney, Agent, or Firm* — Foley & Lardner LLP

(57) ABSTRACT

A glass antenna for a vehicle that has a first element elongated in a first direction, a second element elongated in a second direction, a third element including first, second and third partial elements that are each elongated in specific directions, and a fourth element elongated in the second direction but detours the second element in the second direction.

15 Claims, 13 Drawing Sheets

GLASS ANTENNA AND WINDOW GLASS FOR VEHICLE

BACKGROUND

1. Field of the Invention

The present invention relates to a glass antenna for a vehicle in which, on or in a window glass including a defogger having a plurality of heater wires that run in parallel, first and second antenna conductors, and first and second feeding portions that are adjacent to each other in the direction that is parallel to the parallel running direction of the plurality of heater wires are disposed, and a window glass for a vehicle including the glass antenna.

2. Description of the Related Art

Conventionally, as means for eliminating variation (fading) of the reception level of a radio wave due to interference between a direct wave and a reflected wave reflected from an obstacle such as a mountain or a building, for example, the diversity system is known as disclosed in JP-A-6-21711. In the automobile antenna apparatus disclosed in JP-A-6-21711, a main antenna which receives an FM broadcast, and which outputs an FM main signal, and a sub antenna which receives an FM broadcast, and which outputs an FM sub signal are disposed in a backlite of an automobile. The FM main signal and the FM sub signal are synthesized with a predetermined phase difference. When the level of synthesis is lower than a predetermined value, the phase difference is changed so as to obtain a signal level sufficient for reception. Namely, the level of synthesis is changed by adjusting the phase difference in the synthesis.

Usually, it is known that, by means of increasing the spatial distance between a plurality of antennas in accordance with the wavelength of a radio waves to be received, received signals of the radio wave which are received respectively by the antennas are theoretically not correlated with one another, and the so-called spatial diversity effect is obtained. Namely, as the distance between a plurality of antennas is further increased, it is possible to further decrease the correlation coefficient indicating the degree of correlation between the amplitude variation of a received wave which is received by one of the antennas, and that of a received wave which is received by the other antenna. Therefore, the spatial diversity effect can be sufficiently exerted.

In a glass antenna which is formed on a window glass, however, the physical distance between antennas cannot be measured unlike a pole antenna, and hence it is difficult to design the antenna based on the spatial distance. Therefore, the assignee of the present invention has found that, in the case of a glass antenna in which two antenna conductors are disposed on a window glass for a vehicle, when a radio wave of a constant frequency is transmitted, the spatial diversity effect can be more sufficiently exerted on the glass antenna as the phase difference δ produced between a received wave which is received by one of the antenna conductors, and that which is received by the other antenna conductor is larger. Namely, the phase difference δ can be deemed to be equivalent to the inter-antenna distance.

In order to sufficiently obtain a requested spatial diversity effect, therefore, the phase difference δ which is detected as the characteristics of a glass antenna itself must be increased by tuning the placement positions of antenna conductors, the shapes of the antenna conductors themselves, or the like. When the placement positions of feeding portions respectively for two antenna conductors are separated from each other, for example, also the placement positions of the two antenna conductors can be easily separated from each other, and hence the phase difference δ is liable to be increased.

However, there is a case where feeding portions respectively for two antenna conductors are restricted to be close to each other by request of the specification of a vehicle such as the placement positions of the feeding portions, and wiring locations. In this case, it is difficult to increase the phase difference δ.

SUMMARY

Therefore, it is an object of the invention to provide a glass antenna for a vehicle having antenna characteristics in which, even when feeding portions are close to each other, the phase difference between received waves of antenna conductors constituting a diversity antenna is large, and the gains of the antenna conductors are high, and a window glass for a vehicle including the glass antenna.

According to an aspect of the invention, there is provided a glass antenna for a vehicle, on or in a window glass including a defogger having a plurality of heater wires that run in parallel, the glass antenna including: a first antenna conductor including: a first element; a second element; and a third element; a second antenna conductor including: a fourth element; a first feeding portion; and a second feeding portion, wherein: the first feeding portion and the second feeding portion that are adjacent to each other in a direction that is parallel to the parallel running direction of the plurality of heater wires are disposed; the first element is elongated from the first feeding portion in a first direction which is perpendicular to the parallel running direction, and along which the element approaches the defogger; the second element is elongated from the first element in a second direction which is parallel to the parallel running direction, and which is directed toward the second feeding portion with respect to the first element;

the third element includes: a first partial element which is elongated from the first element in a third direction that is opposite to the second direction; a second partial element which is elongated from the first partial element in a fourth direction that is opposite to the first direction; and a third partial element which is elongated from the second partial element in a direction that is parallel to the parallel running direction; the fourth element is elongated from the second feeding portion in the second direction, and thereafter detours an end of the second element in the second direction, on a side of the second direction to be elongated in the third direction, and the fourth element is not connected with the defogger on direct current.

According to the invention, it is possible to obtain antenna characteristics in which, even when feeding portions are close to each other, the phase difference between received waves of antenna conductors constituting a diversity antenna is large, and the gains of the antenna conductors are high.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE INVENTION

Figure 1:
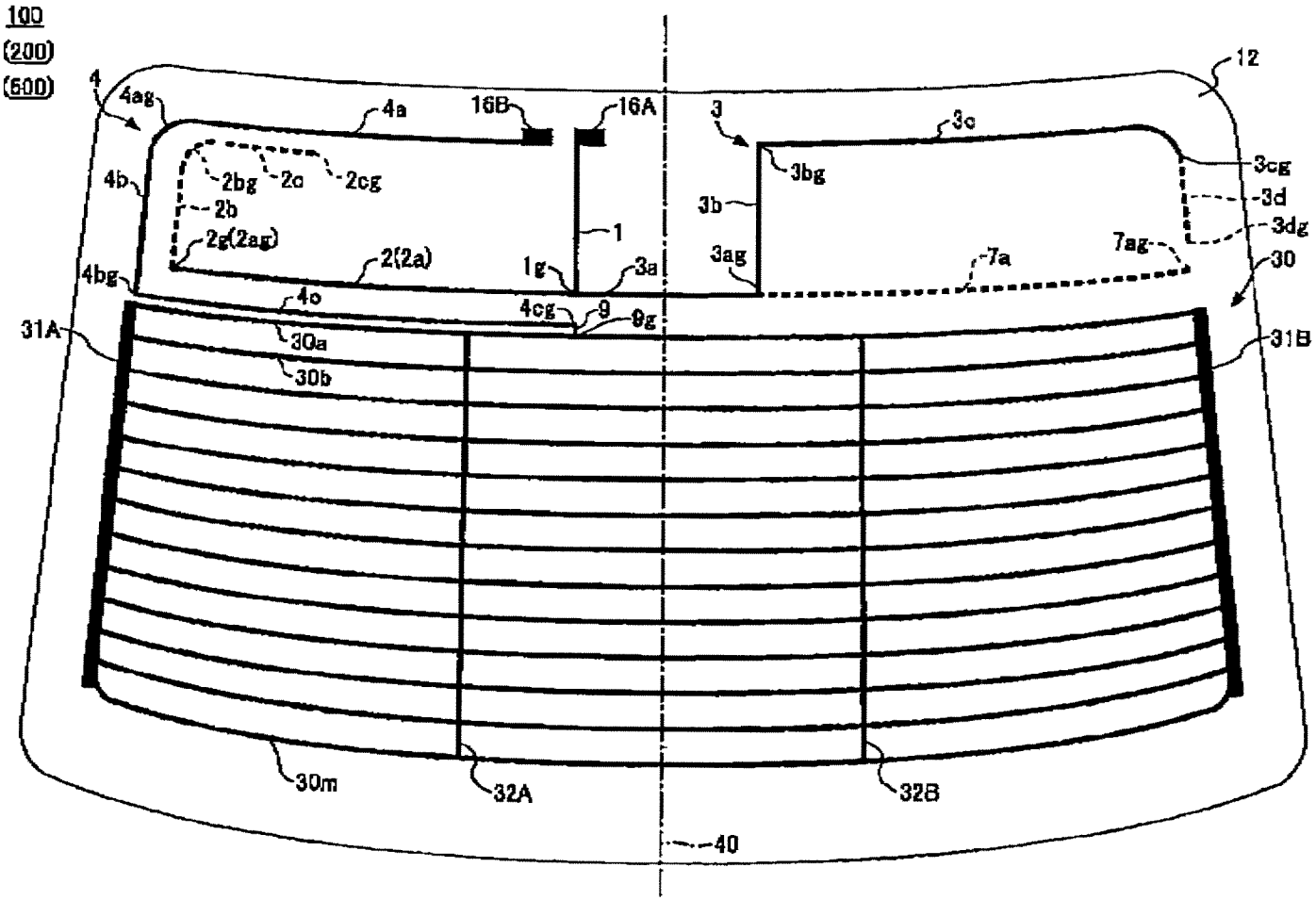
FIG. 1 is a plan view of a glass antenna for a vehicle.

Hereinafter, modes for carrying out the invention will be described with reference to the drawings. In the drawings illustrating the modes, unless described with respect to the directions, the directions are those apparent in the drawings. In the directions such as parallel and perpendicular, a deviation at a degree which does not impair the effects of the invention is allowed. The drawings show figures as viewed when opposed to the face of a window glass, and are views which are seen from the interior of a vehicle in a state where the window glass is mounted to the vehicle. However, the drawings may be referenced as views which are seen from the outside of the vehicle. In the case where the window glass is a backlite to be mounted to a rear portion of a vehicle, for example, the lateral direction in a figure corresponds to the vehicle width direction. The invention is not restricted to a backlite, and may be any window glass as far as a defogger having a plurality of heater wires that run in parallel is disposed.

Figure 14:
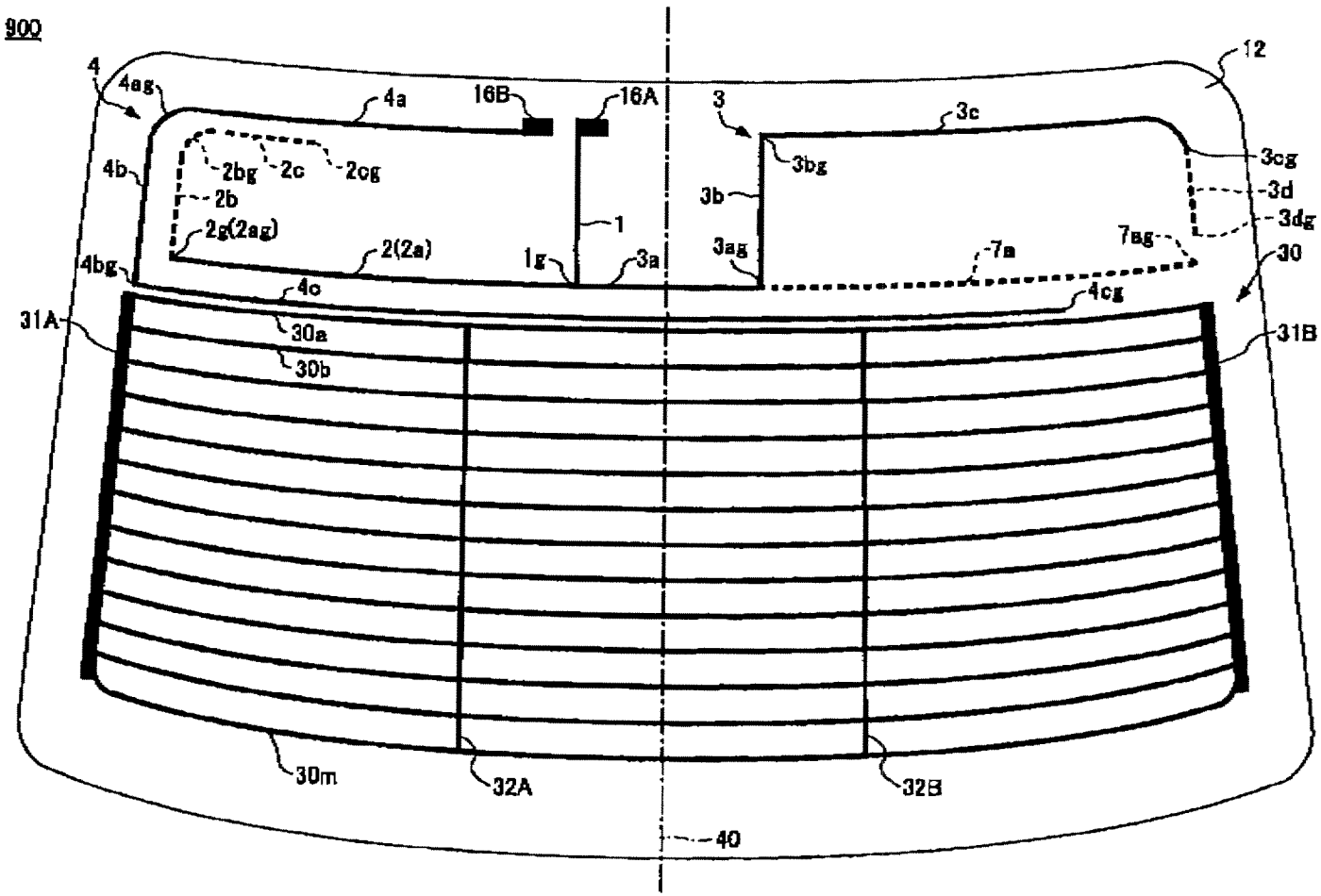
FIG. 14 is a plan view of a glass antenna for a vehicle.

FIG. 14 is a plan view of a glass antenna 900 for a vehicle which is an embodiment of the invention. The glass antenna 900 which is indicated by the solid line in FIG. 14 is an antenna in which, on or in a window glass in which a defogger 30 having a plurality of heater wires that run in parallel is disposed, first and second antenna conductors, and first and second feeding portions that are adjacent to each other in the direction that is parallel to the parallel running direction of the plurality of heater wires are planarly disposed.

The glass antenna 900 is a glass antenna of the diversity system in which the first antenna conductor is set as a main antenna conductor, and the second antenna conductor is set as a sub antenna conductor. Alternatively, the first antenna conductor may be set as a sub antenna conductor, and the second antenna conductor may be set as a main antenna conductor. The first antenna conductor is connected to a feeding portion 16A which is a first feeding portion, and the second antenna conductor is connected to a feeding portion 16B which is a second feeding portion.

The defogger 30 is a pattern of the conduction heating type having the plurality of heater wires (in FIG. 14, thirteen heater wires 30*a* to 30*m* are exemplified) that run in parallel, and a plurality of strip-like bus bars (in FIG. 14, two bus bars 31A, 31B are exemplified) for supplying an electric power to the heater wires. For example, the plurality of heater wires are placed on the window glass 12 so as to run in a direction that is parallel to a horizontal plane (horizon plane) in a state where the window glass 12 is mounted to a vehicle. The number of the heater wires that run in parallel may be two or more. The plurality of heater wires that run in parallel are short-circuited by short-circuit wires 32A, 32B. In the case of FIG. 14, at least one bus bar 31A and at least on bus bar 31B are disposed in the left and right regions of the window glass 12, respectively, and elongated in the vertical or substantially vertical direction of the window glass 12.

As a pattern of the first antenna conductor connected to the feeding portion 16A, the glass antenna 900 includes an antenna element 1 which is a first element; an antenna element 2 which is a second element; and an antenna element 3 which is a third element.

The antenna element 1 is elongated from the feeding portion 16A in a first direction (in the figure, the downward direction) which is perpendicular to the parallel running direction of the heater wires, and along which the element approaches the defogger 30. In the case where the feeding portions 16A, 16B are placed along the outer circumference of the window glass 12 so as to be separated from each other in a direction that is parallel to a horizontal plane (horizon plane) in the state where the window glass 12 is mounted to a vehicle, for example, the antenna element 1 is elongated in a direction which is perpendicular to the separation direction of the feeding portions 16A, 16B, and which is inward directed with respect to the outer circumference of the window glass 12.

The antenna element 2 is elongated from a first end portion 1*g* which is the end of the elongation in the first direction of the antenna element 1, in a second direction (in the figure, the leftward direction) which is parallel to the parallel running direction of the heater wires, and which is directed toward the feeding portion 16B with respect to the antenna element 1. The antenna element 2 is elongated to a second end portion 2*g* which is the end of the elongation in the second direction that is started from the end portion 1*g*.

The antenna element 3 includes an element 3*a* which is a first partial element, an element 3*b* which is a second partial element, and an element 3*c* which is a third partial element. The element 3*a* is elongated from the end portion 1*g* of the antenna element 1 in a third direction (in the figure, the rightward direction) which is opposite to the second direction. The element 3*b* is elongated from an end portion 3*ag* which is the end of the elongation of the element 3*a* in the third direction, in a fourth direction (in the figure, the upward direction) which is opposite to the first direction. The element 3*c* is elongated from an end portion 3*bg* which is the end of the elongation of the element 3*b* in the fourth direction, to an end portion 3*cg* in the third direction. The element 3*c* is elongated from the end portion 3*bg* in the third direction, and then further elongated while being bent in the vicinity of the end portion 3*cg* in the first direction. Alternatively, the element 3*c* may be straightly elongated without being bent.

As a pattern of the second antenna conductor connected to the feeding portion 16B, the glass antenna 900 includes: an antenna element 4 which is a fourth element.

The antenna element 4 is elongated from the feeding portion 16B in the second direction, thereafter further elongated in the first direction on the side of the second direction with respect to the element end (in the case of FIG. 14, the end portion 2*g*) in the second direction of the antenna element 2, and then elongated in the third direction to detour the antenna element 2. The antenna element 4 includes: a partial element 4*a* which is elongated from the feeding portion 16B in the second direction; a partial element 4*b* which is elongated from an end portion 4*ag* of the elongation in the second direction of the partial element 4*a*, in the first direction; and a partial element 4*c* which is elongated from an end portion 4*bg* of the elongation in the first direction of the partial element 4*b*, in the third direction. The partial element 4*c* is elongated along at least one of the heater wire 30*a* which is the uppermost wire in the defogger 30, and the antenna element 2, through a region interposed between the heater wire 30*a* and the antenna element 2 toward an end portion 4*cg*.

The glass antenna 900 does not include a connection element connecting the end portion 4*cg* of the partial element 4*c* with the heater wire 30*a*, and the antenna element 4 is not connected with the defogger 30 on direct current.

Here, "end portion" may be the end point of the elongation of an antenna element, or may be the vicinity of the end point which is a conductor portion in front of the end point.

The feeding portion 16A and the first antenna conductor connected thereto, the feeding portion 16B and the second antenna conductor connected thereto, and the defogger 30 are formed by printing a paste containing a conductive metal, such as a silver paste onto the surface of a window glass sheet on the vehicle interior side, and then baking the paste. However, the forming method is not limited to this. Alternatively, a linear or foil-like member made of a conductive material such as copper may be formed on the surface of a window glass sheet on the vehicle interior or exterior side, or applied by an adhesive agent on a window glass, or formed inside a window glass sheet.

The glass antenna 900 is a diversity type antenna. A received signal of a radio wave which is received by the first antenna conductor is transmitted to a signal processing circuit mounted on the vehicle, through a first conductive member which is electrically connected to the feeding portion 16A corresponding to a feeding point. Similarly, a received signal of a radio wave which is received by the second antenna conductor is transmitted to the signal processing circuit mounted on the vehicle, through a second conductive member which is electrically connected to the feeding portion 16B corresponding to a feeding point.

In the case where a coaxial cable is used as a feeding wire for feeding an electric power to the first antenna conductor through the feeding portion 16A, the inner conductor of the coaxial cable is electrically connected to the feeding portion 16A, and the outer conductor of the coaxial cable is ground-connected to the vehicle body. A configuration may be employed in which a connector for electrically connecting the feeding portion 16A to a conductive member such as a lead wire connected to the signal processing circuit is mounted on the feeding portion 16A. The second antenna conductor and the feeding portion 16B may be similarly configured.

The shapes of the feeding portions 16A, 16B, and the gap between the feeding portions 16A, 16B may be determined in accordance with the shapes of the mounting faces of the conductive member and the connector, and the gap of the mounting faces. From the viewpoint of mounting, it is preferable to use a quadrate shape such, as a square, a substantial square, a rectangle, or a substantial rectangle, or a polygonal shape. Alternatively, a circular shape such as a circle, a substantial circle, an oval, or a substantial oval may be used. The areas of the feeding portions 16A, 16B may be equal to or different from each other.

The antenna element 2 may include a first elongated element which is elongated from an end portion of the elongation in the second direction (in the figure, the leftward direction) that is started from a point (including the end portion 1*g*) on the antenna element 1, in a direction that is perpendicular to the parallel running direction of the heater wires. The first elongated element may be elongated in the fourth direction, and then folded back to the direction that is parallel to the parallel running direction of the heater wires, to be further elongated.

FIG. 1 shows an example of a glass antenna 100 for a vehicle, which can realize effects similar to the glass antenna 900. More specifically, FIG. 1 is a plan view of the glass antenna 100 in which the second antenna conductor of the glass antenna 900 is modified. As a pattern of the second antenna conductor connected to the feeding portion 16B, the glass antenna 100 includes: an antenna element 4 which is a fourth element; and a connection element 9 which connects the antenna element 4 to the defogger 30. The configuration of the glass antenna 100 is identical with that of the glass antenna 900 excepting the configuration of the second antenna conductor.

The connection element 9 connects the end portion of the elongation of the antenna element 4 (i.e., the end portion 4*cg* in the third direction of the elongation of the partial element 4*c*) to the heater wire 30*a* at a connection point 9*g*. The connection element 9 may be linearly elongated from the end portion 4*cg* in the first direction, or may be bent to the first direction.

The glass antenna 900 can act as same as the glass antenna 100 without connecting the second antenna conductor with the defogger 30 via the connection element. Further, since the second antenna conductor is not connected with the defogger 30 in the glass antenna 900, a provision on a defogger side to reduce a noise contamination into the glass antenna, which has to treat when the second antenna conductor is connected with the defogger, can be simplified. Besides, parts of the glass antenna 900, other than the second antenna conductor (for example, the first antenna conductor), may have similar configurations of that of the glass antenna 100.

In view of the above, since the parts of the glass antenna 900, other than the second antenna conductor, may have similar configurations of that of the glass antenna 100, the following explanations with respect to other embodiments of the first antenna conductor of the glass antenna 100 can be considered as explanations with respect to other embodiments of the invention for descriptive purposes.

For example, another embodiment of the invention is a glass antenna 200 for a vehicle in which the antenna element 2 is modified as indicated by the broken line in FIG. 1. The antenna element 2 of the glass antenna 200 includes a first partial element 2*a*, a second partial element 2*b*, and a third partial element 2*c*. The elements 2*b*, 2*c* correspond to the first elongated element. The element 2*a* is elongated from the end portion 1*g* of the antenna element 1 in the second direction. The element 2*b* is elongated from an end portion tag which is the end of the elongation in the second direction of the element 2*a*, in the fourth direction (in the figure, the upward direction), so as not to be connected to the antenna element 4. The element 2*c* is elongated from an end portion 2*bg* which is the end of the elongation in the fourth direction of the element 2*b*, to an end portion 2*cg* in the third direction. The element 2*c* is elongated from the end portion 2*bg* in the third direction, and then elongated to the end portion 2*cg* without being bent to the first direction (or the fourth direction). Alternatively, the element 2*c* may be bent to the first direction (or the fourth direction). The end portion 2*cg* is located on the side of the second direction with respect to the antenna element 1.

Figure 2:
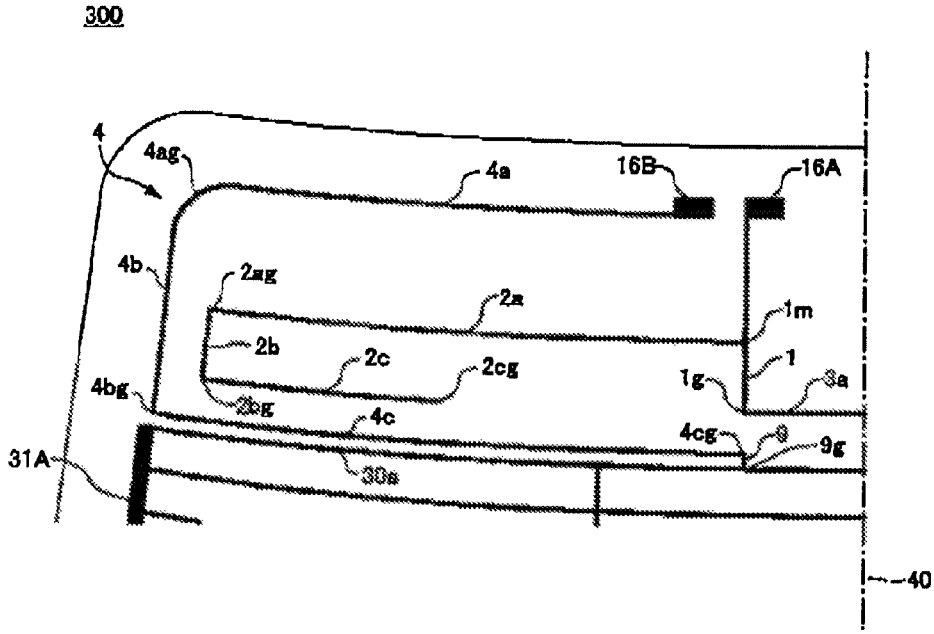
FIG. 2 is a plan view of a glass antenna for a vehicle.

For example, a further embodiment of the invention is a glass antenna 300 for a vehicle in which the antenna element 2 modified as shown in FIG. 2. The description of the portions in FIG. 2 which are configured in the same manner as those of the glass antenna 100 of FIG. 1 is omitted. The antenna element 2 of the glass antenna 300 includes a first partial element 2*a*, a second partial element 2*b*, and a third partial element 2*c*. The elements 2*b*, 2*c* correspond to the first elongated element. The element 2*a* is elongated from an intermediate portion 1*m* of the antenna element 1 in the second direction. The element 2*b* is elongated from an end portion 2*ag* which is the end of the elongation in the second direction of the element 2*a*, in the first direction (in the figure, the downward direction). The element 2*c* is elongated from an end portion 2*bg* which is the end of the elongation in the first direction of the element 2*b*, to an end portion 2*cg* in the third direction, so as not to be connected to the antenna element 4. The element 2*c* is elongated from the end portion 2*bg* in the third direction, and then elongated to the end portion 2*cg* without being bent to the first direction or the fourth direction. Alternatively, the element 2*c* may be bent to the first direction or the fourth direction. The end portion 2*cg* is located on the side of the second direction with respect to the antenna element 1.

Figure 3:
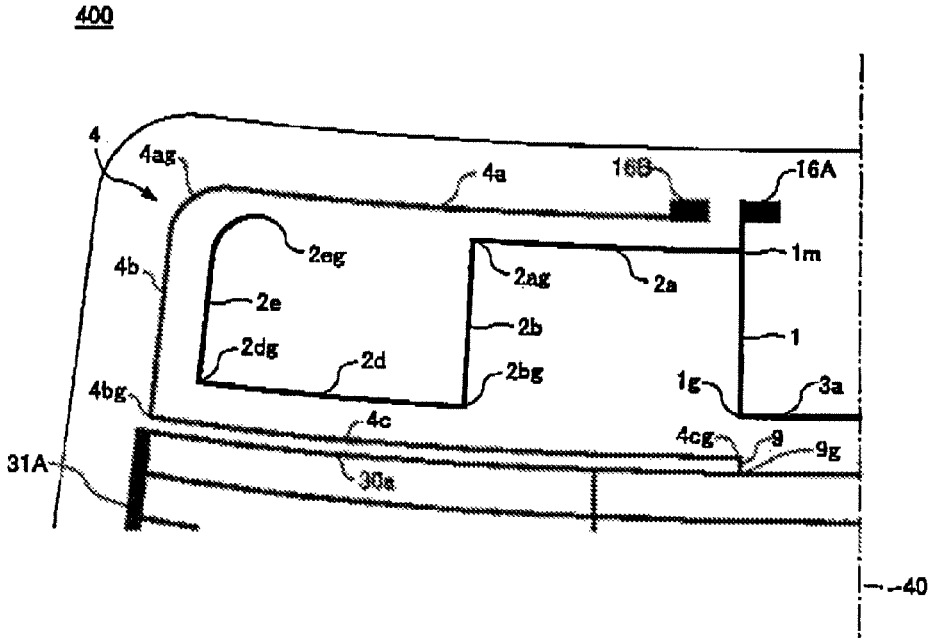
FIG. 3 is a plan view of a glass antenna for a vehicle.

For example, a further embodiment of the invention is a glass antenna 400 for a vehicle in which the antenna element 2 is modified as shown in FIG. 3. The description of the portions in FIG. 3 which are configured in the same manner as those of the glass antenna 100 of FIG. 1 is omitted. The antenna element 2 of the glass antenna 400 includes a first partial element 2*a*, a second partial element 2*b*, a third partial element 2*d*, and a fourth partial element 2*e*. The elements 2*b*, 2*d*, 2*e* correspond to the first elongated element. The element 2*a* is elongated from an intermediate portion 1*m* of the antenna element 1 in the second direction. The element 2*b* is elongated from an end portion tag which is the end of the elongation in the second direction of the element 2*a*, in the first direction. The element 2*d* is elongated from an end portion 2*bg* which is the end of the elongation in the first direction of the element 2*b*, in the second direction. The element 2*e* is elongated from an end portion 2*dg* which is the end of the elongation in the second direction of the element 2*d*, to an end portion 2*eg* in the fourth direction. The element 2*e* is elongated from the end portion 2*dg* in the fourth direction, and then bent to the third direction to be elongated to the end portion 2*eg*. Alternatively, the element 2*e* may not be bent to the third direction. The end portion 2*eg* is located on the side of the second direction with respect to the element 2*b*.

For example, a further embodiment of the invention is a glass antenna 500 for a vehicle in which an auxiliary element 7*a* which is elongated from the element 3*b* in the direction that is parallel to the parallel running direction of the heater wires is added to the glass antenna 100 as indicated by the broken line in FIG. 1. The auxiliary element 7*a* is elongated from a point (including the end portion 3*ag*) on the element 3*b* in the third direction along the heater wire 30*a*. The antenna element 3 further includes a second elongated element which is connected to the element 3*c*, and which is elongated in a direction perpendicular to the parallel running direction of the heater wires or in the first direction in the case of FIG. 1. The element 3*d* corresponds to the second elongated element. The element 3*d* is elongated from the end portion 3*cg* to an end portion 3*dg* in the first direction.

Figure 4:
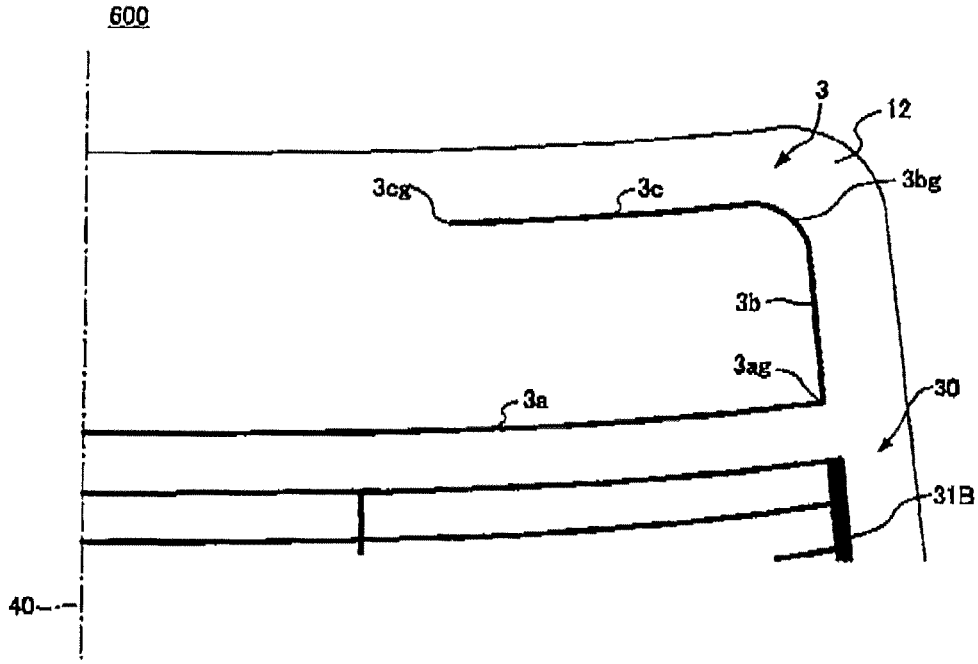
FIG. 4 is a plan view of a glass antenna for a vehicle.

For example, a further embodiment of the invention is a glass antenna 600 for a vehicle in which the antenna element 3 is modified as shown in FIG. 4. The description of the portions in FIG. 4 which are configured in the same manner as those of the glass antenna 100 of FIG. 1 is omitted. The antenna element 3 of the glass antenna 600 includes an element 3*a* which is a first partial element, an element 3*b* which is a second partial element, and an element 3*c* which is a third partial element. The element 3*a* is elongated from the end portion 1*g* of the antenna element 1 in the third direction. The element 3*b* is elongated from an end portion 3*ag* which is the end of the elongation in the third direction of the element 3*a*, in the fourth direction. The element 3*c* is elongated from an end portion 3*bg* which is the end of the elongation in the fourth direction of the element 3*b*, to an end portion 3*cg* in the second direction. The element 3*c* is elongated from the end portion 3*bg* in the second direction, and then further elongated to the end portion 3*cg* without being bent to the first direction or the fourth direction. Alternatively, the element 3*c* may be bent to the first direction or the fourth direction. The end portion 3*cg* is located on the side of the third direction with respect to the antenna element 1.

Figure 5:
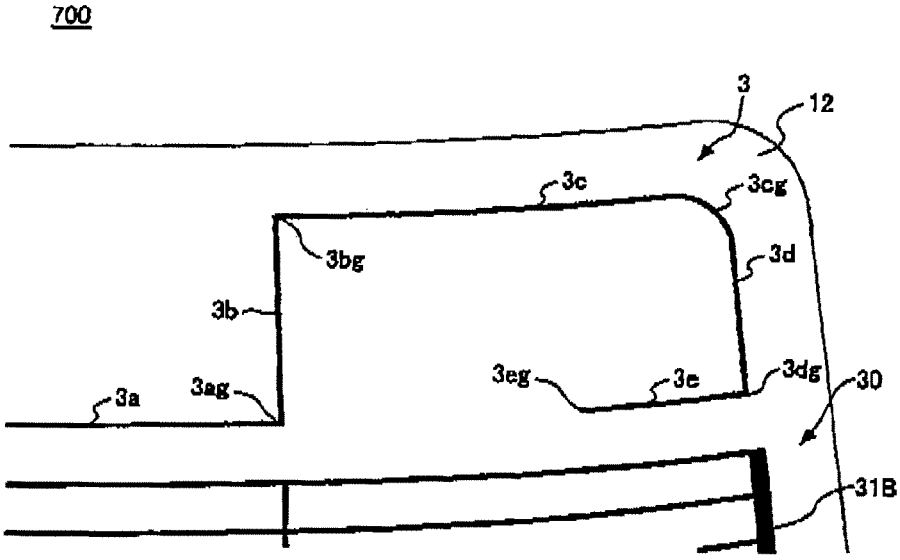
FIG. 5 is a plan view of a glass antenna for a vehicle.

For example, a further embodiment of the invention is a glass antenna 700 for a vehicle in which the antenna element 3 is modified as shown in FIG. 5. The description of the portions in FIG. 5 which are configured in the same manner as those of the glass antenna 100 of FIG. 1 is omitted. The antenna element 3 of the glass antenna 700 includes a second elongated element which is connected to the element 3*c*, and which is elongated in a direction perpendicular to the parallel running direction of the heater wires. After elongated in the direction perpendicular to the parallel running direction of the heater wires, the second elongated element may be folded back to a direction along which the element approaches the element 3*b*. The second elongated element includes an element 3*d* which is a fourth partial element, and an element 3*e* which is a fifth partial element. The element 3*d* is elongated from an end portion 3*cg* in the first direction. The element 3*e* is elongated from an end portion 3*dg* which is the end of the elongation in the first direction of the element 3*d*, to an end portion 3*eg* in the second direction. The end portion 3*eg* is located on the side of the third direction with respect to the element 3*b*.

Figure 6:
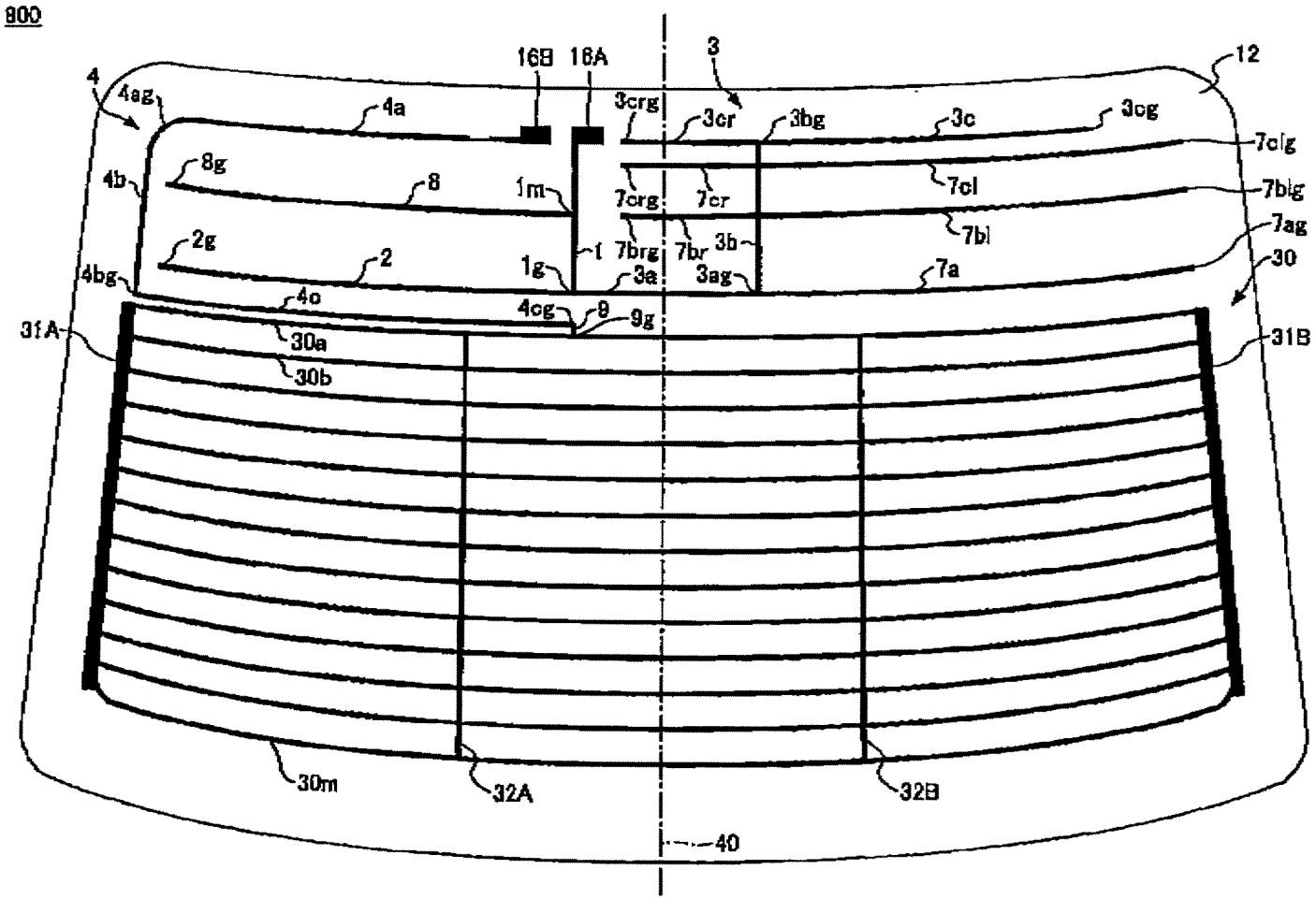
FIG. 6 is a plan view of a glass antenna for a vehicle.

FIG. 6 is a plan view of a glass antenna 800 for a vehicle in which the first antenna conductor of the glass antenna 100 of FIG. 1 is modified. In the glass antenna 800, a plurality of auxiliary elements are added to the first antenna conductor of the glass antenna 100. The first antenna conductor of the glass antenna 800 includes a first auxiliary element group which is configured by one or two or more auxiliary elements that are elongated from the antenna element 1 in the direction that is parallel to the parallel running direction of the heater wires. The first antenna conductor of the glass antenna 800 further includes a second auxiliary element group which is configured by one or two or more auxiliary elements that are elongated from the element 3*b* in the direction that is parallel to the parallel running direction of the heater wires.

As the first auxiliary element group, FIG. 6 shows an auxiliary element 8. The auxiliary element 8 is elongated from an intermediate portion 1*m* of the antenna element 1 to an end portion 8*g* in the second direction. The end portion 8*g* is located on the side of the third direction with respect to the element 4*b*. As the second auxiliary element group, FIG. 6 shows an auxiliary element 7*a*, an auxiliary element 7*b* (7*bl*, 7*br*), and an auxiliary element 7*c* (7*cl*, 7*cr*). The auxiliary element 7*a* is elongated from an end portion 3*ag* to an end portion lag in the third direction. The auxiliary element 7*b* is elongated from the element 3*b* to an end portion 7*brg* in the second direction, and then elongated to an end portion 7*blg* in the third direction. The auxiliary element 7*c* is elongated from the element 3*b* to an end portion 7*crg* in the second direction, and then elongated to an end portion 7*clg* in the third direction. When at least one of the first and second auxiliary element groups is disposed, it is possible to improve the antenna gain in the AM band.

Referring to FIG. 6, the antenna element 3 includes a partial element 3*cr* which is elongated from an end portion 3*bg* of the element 3*b* to an end portion 3*crg* in the second direction, and a partial element 3*c* which is elongated to an end portion 3*cg* in the third direction.

According the glass antennas which are exemplified in FIGS. 1 to 6 and 14, it is possible to obtain antenna characteristics in which, even when the feeding portions are close to each other, the phase difference between received waves of the antenna conductors constituting the diversity antenna is large, and the antenna conductors have a high gain.

A case where the wavelength in the air at the center frequency of a desired broadcast frequency band which is a broadcast frequency band to be received is indicated by $\lambda_0$, the shortening coefficient of wavelength in the glass is indicated by k (k=0.64), and $\lambda_g=\lambda_0 \cdot k$ is set will be considered. In the invention, also in consideration of a glass antenna including a pattern in which the antenna elements 1, 2 have branches, when the length of the conductor path that is longest among conductor paths through which the feeding portion 16A and the end of the elongation of the element 2 are connected to each other at the shortest distance is $0.19\lambda_g$ to $0.33\lambda_g$ (particularly, $0.22\lambda_g$ to $0.30\lambda_g$), a result which is preferred from the viewpoint of improvement of the antenna gain in the broadcast frequency band is obtained.

Namely, the conductor lengths of the antenna conductors are adjusted so that the length of the conductor path that is longest among conductor paths through which the feeding portion 16A and the end of the elongation of the element 2 are connected to each other at the shortest distance coincides with $0.25\lambda_g$ ($=\lambda_g/4$).

For example, the length of the conductor path that is longest among conductor paths through which the feeding portion 16A and the end of the elongation of the element 2 are connected to each other at the shortest distance means the length of the conductor path connecting the feeding portion 16A, the end portion 1*g*, and the end portion 2*g* to one another in the case of FIGS. 1 and 14, the length of the conductor path connecting the feeding portion 16A, the intermediate portion 1*m*, and the end portion 2*cg* to one another in the case of FIG. 2, and the length of the conductor path connecting the feeding portion 16A, the intermediate portion 1*m*, and the end portion leg to one another in the case of FIG. 3.

For example, the center frequency of the FM broadcast band (76 to 90 MHz) in Japan is 83 MHz, and $\lambda_g$ at 83 MHz is 2,313 mm. In the case where the FM broadcast band (88 to 108 MHz) in USA is set as the reception frequency band, the center frequency is 98 MHz. In the case where Low band (90 to 108 MHz) of the television VHF band is set as the reception frequency band, the center frequency is 99 MHz.

For the purpose of improving the antenna gain in the case where receiving wave is the FM broadcast band (76 to 90 MHz) in Japan, therefore, $\lambda_g$ at the center frequency of 83 MHz is 2,313 mm, and hence the length of the conductor path that is longest among conductor paths through which the feeding portion 16A and the end of the elongation of the element 2 are connected to each other at the shortest distance is adjusted from 440 to 763 mm (particularly, 509 to 693 mm). In examples described later, for example, the length is adjusted from 450 to 750 mm.

In the case where the wavelength in the air at the center frequency of a desired broadcast frequency band which is a broadcast frequency band to be received is indicated by $\lambda_0$, the shortening coefficient of wavelength in the glass is indicated by k (k=0.64), and $\lambda_g=\lambda_0 \cdot k$ is set, also in consideration of a glass antenna including a pattern in which the antenna elements 1, 3 have branches, when the length of the conductor path that is longest among conductor paths through which the feeding portion 16A and the end of the elongation of the element 3 are connected to each other at the shortest distance is $0.38\lambda_g$ to $0.44\lambda_g$ (particularly, $0.40\lambda_g$ to $0.42\lambda_g$), a result which is preferred from the viewpoint of improvement of the antenna gain in the broadcast frequency band is obtained.

For example, the length of the conductor path that is longest among conductor paths through which the feeding portion 16A and the end of the elongation of the element 3 are connected to each other at the shortest distance means the length of the conductor path connecting the feeding portion 16A the end portion 3*cg* to one another in the case of FIGS. 1, 4 and 14, the length of the conductor path connecting the feeding portion 16A and the end portion 3*eg* to one another, in the case of FIG. 5, and the length of the conductor path connecting the feeding portion 16A and the end portion 3*cg* to one another in the case of FIG. 6.

For the purpose of improving the antenna gain in the case where receiving wave is the FM broadcast band (76 to 90 MHz) in Japan, therefore, $\lambda_g$ at the center frequency of 83 MHz is 2,313 mm, and hence the length of the conductor path that is longest among conductor paths through which the feeding portion 16A and the end of the elongation of the element 3 are connected to each other at the shortest distance is adjusted from 879 to 1,017 mm (particularly, 926 to 971 mm). In the examples described later, for example, the length is adjusted from 900 to 1,000 mm.

In the case where the wavelength in the air at the center frequency of a desired broadcast frequency band which is a broadcast frequency band to be received is indicated by $\lambda_0$, the shortening coefficient of wavelength in the glass is indicated by k (k=0.64), and $\lambda_g=\lambda_0 \cdot k$ is set, when the gap (the gap in the direction that is parallel to the parallel running direction of the heater wires) between the antenna element 1 and the element 3*b* is $0.13\lambda_g$ or shorter (particularly, $0.10\lambda_g$ or shorter), a result which is preferred from the viewpoint of improvement of the antenna gain in the broadcast frequency band is obtained.

For the purpose of improving the antenna gain in the case where receiving wave is the FM broadcast band (76 to 90 MHz) in Japan is to be improved, therefore, $\lambda_g$ at the center frequency of 83 MHz is 2,313 mm, and hence the gap (the gap in the direction that is parallel to the parallel running direction of the heater wires) between the antenna element 1 and the element 3*b* is adjusted to 300 mm or shorter (particularly, 231 mm or shorter, and more particularly, 200 mm or shorter).

The minimum value of the gap (the gap in the direction that is parallel to the parallel running direction of the heater wires) between the antenna element 1 and the element 3*b* is requested to be equal to or larger than the length which is minimally required in order that the antenna element 1 and the element 3*b* function not as the same element but as different elements.

In the glass antenna 100, when the shortest distance from the connection point 9*g* of the connection element 9 and the heater wire 30*a* of the defogger 30, to the center line 40 of the defogger 30 (or the window glass 12) in the parallel running direction of the heater wires is −150 to −50 mm, a result which is preferred from the viewpoint of improvement of the antenna gain in the broadcast frequency band is obtained.

The center line 40 is a virtual line which is drawn in parallel to the first direction. The sign of the shortest distance to the center line 40 of the defogger 30 (or the window glass 12) in the parallel running direction of the heater wires is set to positive when the connection point 9*g* is located on the side of the third direction with respect to the center line 40, and set to negative when the point is located on the side of the second direction with respect to the center line 40.

In the case where the wavelength in the air at the center frequency of a desired broadcast frequency band which is a broadcast frequency band to be received is indicated by $\lambda_0$, the shortening coefficient of wavelength in the glass is indicated by k (k=0.64), and $\lambda_g=\lambda_0 \cdot k$ is set, when the conductor length of the antenna element 4, in a case that the connection element 9 is not provided as shown in FIG. 14, is set to a length obtained by adding about $(1/4)\lambda_g$ to the conductor length of the antenna element 4, in a case that the connection element 9 is provided, a result which is preferred from the viewpoint of improvement of the antenna gain in the broadcast frequency band is obtained.

For the purpose of improving the antenna gain in the case where receiving wave is the FM broadcast band (76 to 90 MHz) in Japan is to be improved, therefore, $\lambda_g$ at the center frequency of 83 MHz is 2,313 mm, and hence the conductor length of the antenna element 4, in the case that the connection element 9 is not provided as shown in FIG. 14, is adjusted to a conductor length obtained by adding about 578 mm to the conductor length of the antenna element 4, in the case that the connection element 9 is provided. Specifically, 528 to 628 mm may be added to adjust the conductor length.

In view of the above, in the case that the connection element 9 is not provided as shown in FIG. 14, when the shortest distance from the end portion 4*cg* of the elongation of the antenna element 4 and the heater wire 30*a* of the defogger 30 to the center line 40 of the defogger 30 (or the window glass 12) in the parallel running direction of the heater wires is 400 to 500 mm, a result which is preferred from the viewpoint of improvement of the antenna gain in the broadcast frequency band is obtained.

The center line 40 is a virtual line which is drawn in parallel to the first direction. The sign of the shortest distance to the center line 40 of the defogger 30 (or the window glass 12) in the parallel running direction of the heater wires is set to positive when the end portion 4*cg* is located on the side of the third direction with respect to the center line 40, and set to negative when the end portion is located on the side of the second direction with respect to the center line 40.

Alternatively, the glass antenna may be configured by disposing a conductive layer configured by the antenna conductors on the surface of or in a film made of a synthetic resin, and forming the synthetic resin-made film having the conductive layer on the surface of a window glass sheet on the vehicle interior or exterior side. Alternatively, the glass antenna may be configured by forming a flexible circuit board in which antenna conductors are formed, on the surface of a window glass sheet on the vehicle interior or exterior side.

The mounting angle of the window glass to the vehicle is preferably 15 to 90°, particularly 30 to 90° with respect to a horizontal plane (horizon plane).

A cover film may be formed on the surface of the window glass, and a part or the whole of the antenna conductors may be disposed on the shielding film. An example of the cover film is a black enamel film. In this case, the window glass have an excellent design because, when viewed from the vehicle exterior side, portions of the antenna conductors disposed on the shielding film are caused to be invisible from the vehicle exterior side by the shielding film. In the illustrated configurations, in the case where at least a part of the feeding portions and the antenna conductors is formed on the shielding film, only the thin linear portions of the conductors are seen when viewed from the vehicle exterior side, and hence this is preferable in design.

Results of measurements of the antenna gain and phase difference of automobile glass antennas which are produced by mounting the embodiments of the glass antenna shown in FIGS. 1 to 6 and 14 to the backlite of an actual vehicle will be described.

The antenna gain and the phase difference were measured setting a window frame of an automobile on a turntable, and a glass antenna is formed in an automobile window glass which is attached to the automobile where the glass is inclined by 20° with respect to the horizontal plane. Connectors are attached to the feeding portions, and connected to an amplifier having a gain of 8 dB. The amplifier is connected to a tuner through a feed line (1.5 C-2 v 4.5 m). The turn table is rotated so that the window glass is horizontally illuminated by the radio wave in the all direction, and the radio wave is a polarized wave of a frequency of from 76 to 90 MHz in which the polarization plane is inclined by 45 degrees from the horizontal.

The measurements of the antenna gain and the phase difference are performed by setting the center position of the automobile to which a glass of a glass antenna is mounted, to the center of the turntable, and rotating the automobile through 360°. The data of the antenna gain and the phase difference are measured at an interval of 5° of the rotation angle, and every 1 MHz in the radiation frequency band of from 76 to 90 MHz. The measurement was performed while setting the elevation angle between the transmission position of a radio wave and an antenna conductor to a substantially horizontal direction (the direction of elevation angle=0° in the case where a plane which is parallel to the ground is elevation angle=0°, and the zenith direction is elevation angle=90°).

FIGS. 7A to 8C show data of measurements of the antenna gain and the phase difference in which, in automobile high-frequency glass antennas which were produced by mounting the embodiments of the glass antennas shown in FIGS. 1, 2, and 3 to the backlites of actual vehicles, the length xC of the conductor path that is longest among conductor paths through which the feeding portion 16A and the end of the elongation of the element 2 are connected to each other at the shortest distance was changed.

Figure 7A:
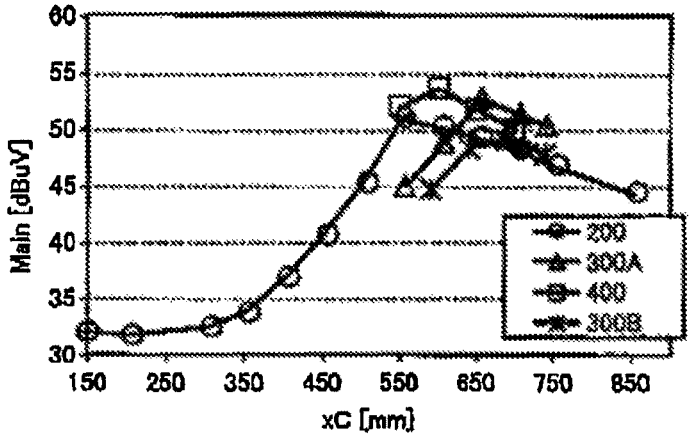
FIGS. 7A to 7C are graphs showing measured data of the antenna gain and the phase difference when a conductor length xC was changed.
Figure 7B:
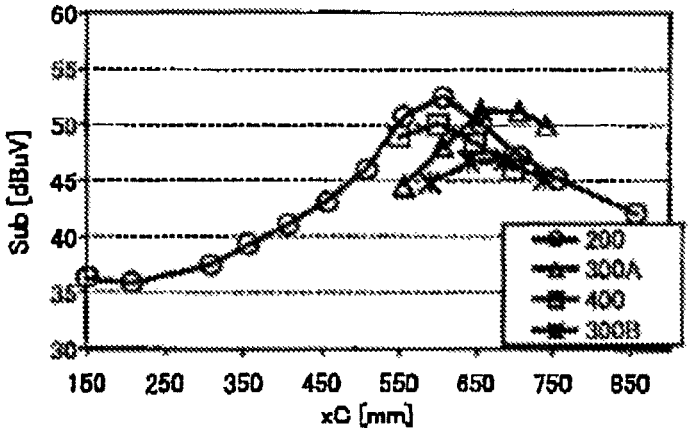
Figure 7C:
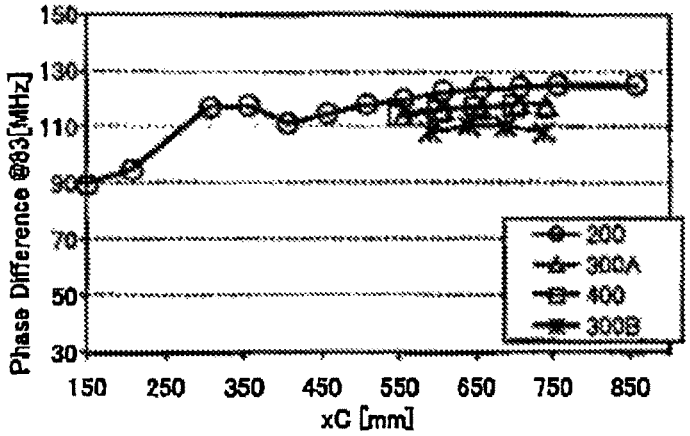
Figure 8A:
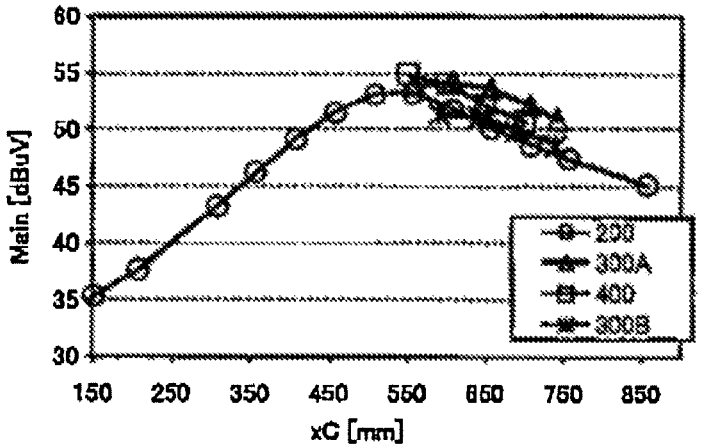
FIGS. 8A to 8C are graphs showing measured data of the antenna gain and the phase difference when the conductor length xC was changed.
Figure 8B:
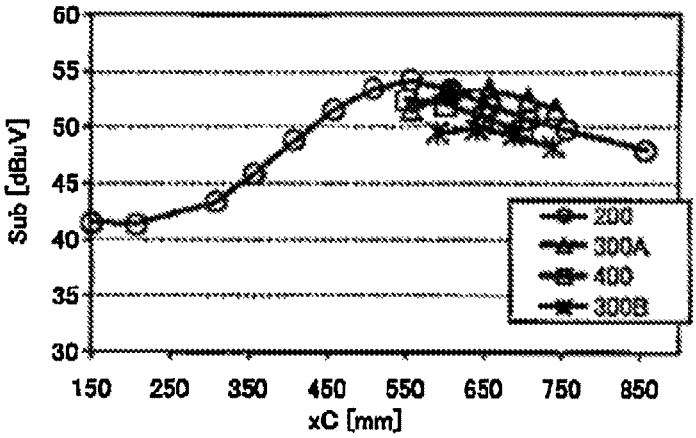
Figure 8C:
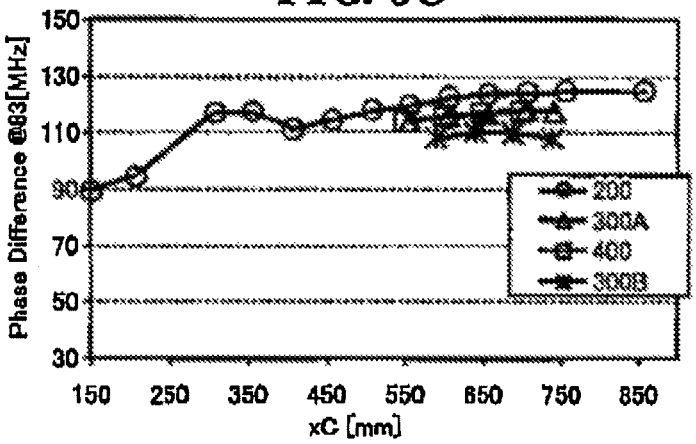

The ordinate in FIG. 7A indicates the minimum value in the band of from 76 to 90 MHz of the averaged antenna gains of the first antenna conductor (main antenna) which are obtained by measuring every 1 MHz and averaging over 360° in Azimuth direction at respective frequencies. Similarly, the ordinate in FIG. 7B indicates the minimum value of the antenna gains of the second antenna conductor (sub antenna) which are measured every 1 MHz in the radiation frequency band of from 76 to 90 MHz. The ordinate in FIG. 7C indicates the average value over 360° in Azimuth direction of absolute values of the phase differences between the measured receiving waves received by the first and second antenna conductors respectively, at an interval of 5° of the rotation angle at a radiation frequency of 83 MHz. The ordinate in FIG. 8A indicates the average value of the antenna gains of the first antenna conductor (main antenna) which are measured every 1 MHz in the radiation frequency band of from 76 to 90 MHz. The ordinate in FIG. 8B indicates the average value of the antenna gains of the second antenna conductor (sub antenna) which are measured every 1 MHz in the radiation frequency band of from 76 to 90 MHz. The ordinate in FIG. 5C indicates the average value which is obtained by, with respect to received waves received respectively by the first and second antenna conductors, measuring phase differences at an interval of 1° of the rotation angle at a radiation frequency of 83 MHz, and averaging absolute values of the phase differences over 360° in Azimuth direction.

Antennas 300A, 300B are different in conductor length between the feeding portion 16A and the intermediate portion 1*m* in the embodiment of the glass antenna 300 shown in FIG. 2.

The length of the conductor path that is longest among conductor paths through which the feeding portion 16A and the end of the elongation of the element 3 are connected to each other at the shortest distance is indicated by xA, the gap (the gap in the direction that is parallel to the parallel running direction of the heater wires) between the antenna element 1 and the element 3*b* is indicated by xB, the length of the conductor path that is longest among conductor paths through which the feeding portion 16A and the end of the elongation of the element 2 are connected to each other at the shortest distance is indicated by xC, and the shortest distance from the connection point 9*g* of the connection element 9 and the heater wire 30*a* of the defogger 30, to the center line 40 of the defogger 30 (or the window glass 12) in the parallel running direction of the heater wires is indicated by xD.

The conductor length of the antenna element 1 is indicated by x1, the conductor lengths of the elements 3*a*, 3*b* are indicated by x3*a* and x3*b*, respectively, the conductor length of the element 4 is indicated by x4, that of the connection element 9 is indicated by x9, the shortest distance between the end of the element 2 in the first direction and the element 4*c* is indicated by x11, the conductor length between the feeding portion 16A and the intermediate portion 1*m* is indicated by x12, and the separation distance between the feeding portions 16A, 163 is indicated by x13.

The shortest distance between the center line 40 and the antenna element 1 is indicated by x21, that between the center line 40 and the partial element 2*b* is indicated by x22, that between the center line 40 and the short-circuit wire 32A is indicated by x23, and that between the center line 40 and the short-circuit wire 32B is indicated by x24.

The antenna conductors of the glass antennas shown in FIGS. 1, 2, and 3 have the following dimensions:

xA: 940 mm
xB: 193 mm
xD: −93 mm
x1: 150 mm
x3*a*: 193 mm
x3*b*: 150 mm
x4: 960 mm (total length of 4*a*, 4*b*, and 4*c*)
x9: 10 mm
x11: 30 mm
x12: 100 mm (in case of antenna 300A)
x12: 30 mm (in case of antennas 300B, 400)
x13: 30 mm
x21: 93 mm
x22: 500 mm (in case of antennas 200, 300A, 300B)
x22: 300 mm (in case of antenna 400)
x23: 200 mm
x24: 200 mm
size of length×width of defogger 30: 420 mm×1,080 mm.

The antenna conductors have a width of 0.8 mm. The feeding portion 16A and the feeding portion 16B have the same size. The bus bar 31A is connected to the vehicle ground through an FM coil (not shown), and the bus bar 31B is connected to the anode of a DC power supply through an FM coil (not shown).

As shown in FIGS. 7A to 8C, when xC is adjusted from 450 to 750 mm, therefore, the antenna gains of the first and second antenna conductors can be enhanced while ensuring that the phase difference is about 100° or more.

Figure 9A:
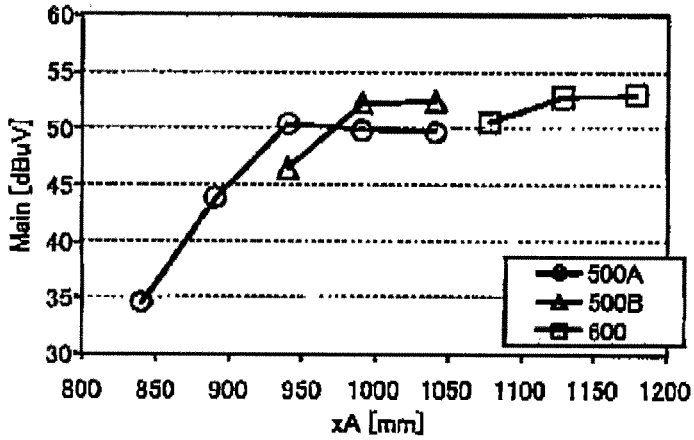
FIGS. 9A to 9C are graphs showing measured data of the antenna gain and the phase difference when a conductor length xA was changed.
Figure 9B:
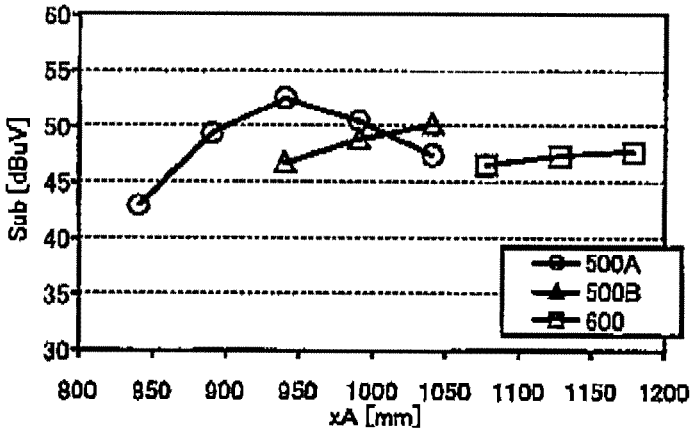
Figure 9C:
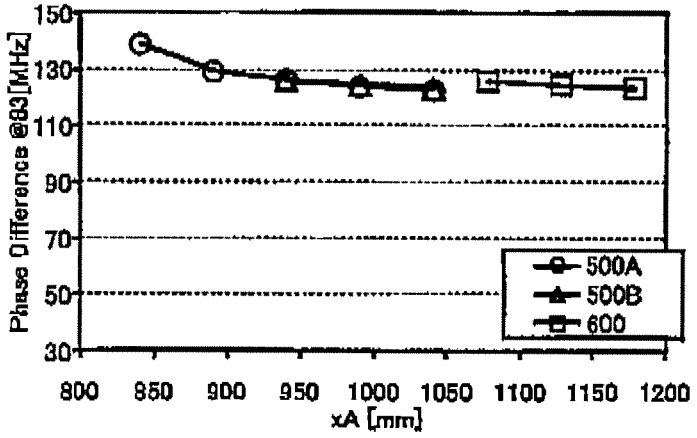

FIGS. 9A to 9C show data of measurements of the antenna gain and the phase difference in which, in automobile high-frequency glass antennas mounted to the backlites of actual vehicles embodying the glass antenna 500 shown in FIG. 1 and the glass antenna 600 shown in FIG. 4, the length xA of the conductor path that is longest among conductor paths through which the feeding portion 16A and the end of the elongation of the element 3 are connected to each other at the shortest distance was changed. The measurement conditions are identical with those of the case of FIGS. 7A to 8C.

The ordinate in FIG. 9A indicates the minimum value in the band among average values which are obtained by measuring an antenna gain of the first antenna conductor (main antenna) every 1 MHz in the radiation frequency band of from 76 to 90 MHz, and averaging antenna gains that are measured at respective frequencies, over 360° in Azimuth direction. Similarly, the ordinate in FIG. 9B indicates the minimum value of the antenna gains of the second antenna conductor (sub antenna) which are measured every 1 MHz in the radiation frequency band of from 76 to 90 MHz. The ordinate in FIG. 9C indicates the average value which is obtained by, with respect to received waves received respectively by the first and second antenna conductors, measuring phase differences at an interval of 5° of the rotation angle at a radiation frequency of 83 MHz, and averaging absolute values of the phase differences over 360° in Azimuth direction.

Antennas 500A, 500B are different in gap xB (the gap in the direction that is parallel to the parallel running direction of the heater wires) between the antenna element 1 and the element 3*b* and conductor length x7*a* of the auxiliary element 7*a*.

The shortest distance between the center line 40 and the end portion 2*g* is indicated by x31.

The antenna conductors of the glass antennas shown in FIGS. 1 and 4 have the following dimensions:

xB: 193 mm in case of glass antenna 500A)
xB: 343 mm (in case of glass antenna 500B)
xB: 628 mm (in case of glass antenna 600)
xC: 572 mm
x7*a*: 435 mm (in case of glass antenna 500A)
x7*a*: 150 mm (in case of glass antenna 500B)
x31: 515 mm.

The description of the dimensions which are identical with the above-described dimensions of the antenna conductors of the glass antennas shown in FIGS. 1, 2, and 3 in the case where the data of FIGS. 7A to 8C are measured is omitted.

As shown in FIGS. 9A to 9C, when xA is adjusted from 900 to 1,000 mm, therefore, the antenna gains of the first and second antenna conductors can be enhanced while ensuring that the phase difference is about 120° or more.

Figure 10:
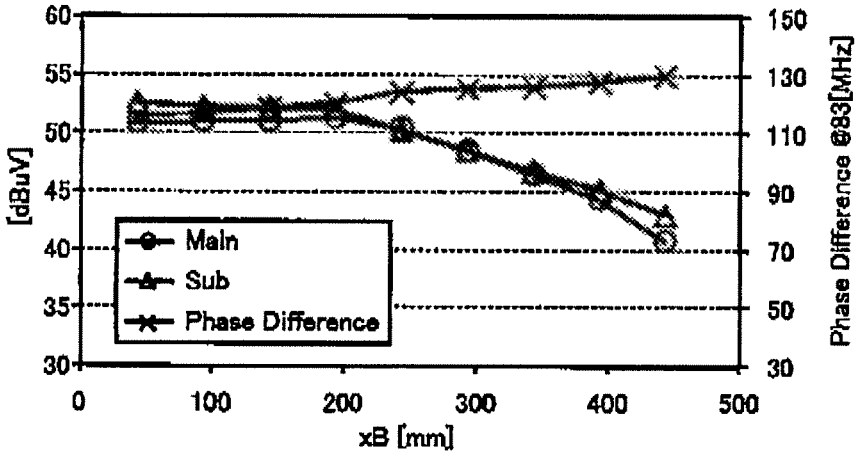
FIG. 10 is a graph showing measured data of the antenna gain and the phase difference when a conductor length xB was changed.

FIG. 10 shows data of measurements of the antenna gain and the phase difference in which, in automobile high-frequency glass antennas mounted to the backlite of an actual vehicle embodying the glass antenna 100 shown in FIG. 1, the gap xB between the antenna element 1 and the element 3*b* was changed. The measurement conditions are identical with those of the case of FIGS. 7A to 8C.

The left ordinate in FIG. 10 indicates the minimum value in the band among average values which are obtained by measuring antenna gains of the first antenna conductor (main antenna) and the second antenna conductor (sub antenna) every 1 MHz in the radiation frequency band of from 76 to 90 MHz, and averaging antenna gains that are measured at respective frequencies, over 360° in Azimuth direction. The right ordinate in FIG. 10 indicates the average value which is obtained by, with respect to received waves received respectively by the first and second antenna conductors, measuring phase differences at an interval of 5° of the rotation angle at a radiation frequency of 83 MHz, and averaging absolute values of the phase differences over 360° in Azimuth direction.

The antenna conductors of the glass antenna 100 shown in FIG. 1 have the following dimensions:

xA: 940 mm
xC: 572 mm
xD: −93 mm
x1: 150 mm
x3*a*: equal to and changed in conjunction with xB
x3*b*: 150 mm
x4: 960 mm (total length of 4*a*, 4*b*, and 4*c*)
x9: 10 mm
x11: 30 mm
x13: 30 mm
x21: 93 mm
x31: 515 mm.

The description of the dimensions which are identical with the above-described dimensions of the antenna conductors of the glass antennas shown in FIGS. 1, 2, and 3 in the case where the data of FIGS. 7A to 8C are measured is omitted.

As shown in FIG. 10, when xB is adjusted to 300 mm or shorter, therefore, the antenna gains of the first and second antenna conductors can be enhanced while ensuring that the phase difference is about 110° or more.

FIGS. 11A to 12C show data of measurements of the antenna gain and the phase difference in which, in automobile high-frequency glass antennas mounted to the backlites of actual vehicles embodying the glass antenna 100 shown in FIG. 1 and the glass antenna 700 shown in FIG. 5, the shortest distance xD between the connection point 9*g* and the center line 40 was changed. The measurement conditions are identical with those of the case of FIGS. 7A to 8C.

Figure 11A:
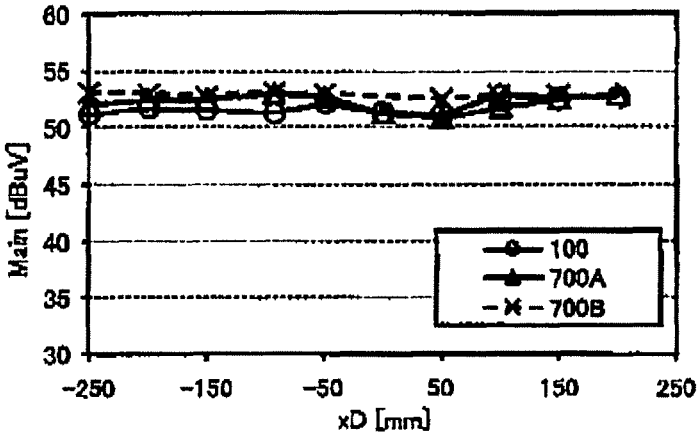
FIGS. 11A to 11C are graphs showing measured data of the antenna gain and the phase difference when a distance xD was changed.
Figure 11B:
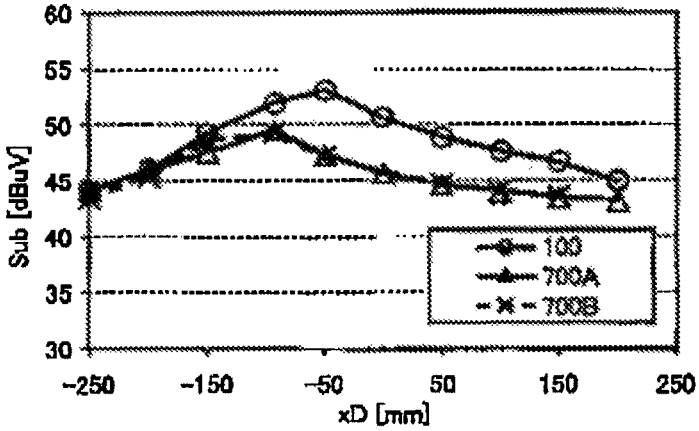
Figure 11C:
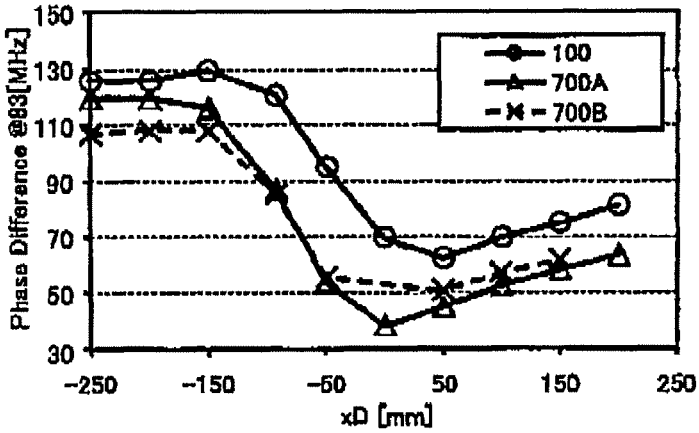

The ordinate in FIG. 11A indicates the minimum value in the band among average values which are obtained by measuring an antenna gain of the first antenna conductor (main antenna) every 1 MHz in the radiation frequency band of from 76 to 90 MHz, and averaging antenna gains that are measured at respective frequencies, over 360° in Azimuth direction. Similarly, the ordinate in FIG. 11B indicates the minimum value of the antenna gains of the second antenna conductor (sub antenna) which are measured every 1 MHz in the radiation frequency band of from 76 to 90 MHz. The ordinate in FIG. 11C indicates the average value which is obtained by, with respect to received waves received respectively by the first and second antenna conductors, measuring phase differences at an interval of 5° of the rotation angle at a radiation frequency of 83 MHz, and averaging absolute values of the phase differences over 360° in Azimuth direction. The ordinate in FIG. 12A indicates the average value of the antenna gains of the first antenna conductor (main antenna) which are measured every 1 MHz in the radiation frequency band of from 76 to 90 MHz. The ordinate in FIG. 12B indicates the average value of the antenna gains of the second antenna conductor (sub antenna) which are measured every 1 MHz in the radiation frequency band of from 76 to 90 MHz. The ordinate in FIG. 12C indicates the average value which is obtained by, with respect to received waves received respectively by the first and second antenna conductors, measuring phase differences at an interval of 5° of the rotation angle at a radiation frequency of 83 MHz, and averaging absolute values of the phase differences over 360° in Azimuth direction.

Antennas 700A, 700B are different in length xA of the conductor path connecting the feeding portion 16A to the end 3*eg* of the elongation of the element 3.

The antenna conductors of the glass antenna 100 shown in FIG. 1 have the following dimensions:

xA: 940 mm (in case of xD=−250, −200, −150, or −93 mm)
xA: 990 mm (in case of xD=−50 mm)
xA: 1,040 mm (in case of xD=50 mm)
xA: 1,090 mm (in case of xD=100 or 150 mm)
xA: 1,140 mm (in case of xD=200 mm)
xB: 193 mm
xC: 572 mm
x1: 150 mm
x3*a*: 193 mm
x3*b*: 150 mm
x4: equal to and changed in conjunction with xD
x9: 10 mm
x11: 30 mm
x13: 30 mm
x21: 93 mm
x31: 515 mm.

The description of the dimensions which are identical with the above-described dimensions of the antenna conductors of the glass antennas shown in FIGS. 1, 2, and 3 in the case where the data of FIGS. 7A to 8C are measured is omitted.

The antenna conductors of the glass antenna 700 shown in FIG. 5 have the following dimensions:

xA: 1,040 mm (in case of the glass antenna 700A)
xA: 1,090 mm (in case of the glass antenna 700B)
xB: 193 mm
xC: 557 mm
x1: 150 mm
x3*a*: 193 mm
x3*b*: 150 mm
x4: equal to and changed in conjunction with xD
x9: 10 mm
x11: 30 mm
x13: 30 mm
x21: 7 mm
x31: 400 mm.

The description of the dimensions which are identical with the above-described dimensions of the antenna conductors of the glass antennas shown in FIGS. 1, 2, and 3 in the case where the data of FIGS. 7A to 8C are measured is omitted.

As shown in FIGS. 11A to 12C, therefore, the antenna gain of the first antenna conductor (main antenna) has a substantially constant value irrespective of the value of xD, and that of the second antenna conductor (sub antenna) is further lowered as xD is more increased or decreased with respect to the vicinity of −50 mm. Furthermore, the phase difference is further increased as xD is more increased or decreased with respect to the vicinity of −50 mm. From the viewpoint that both the antenna gain and the phase difference are satisfied, by adjusting xD from −150 mm to −50 mm, the gains of the first and second antenna conductors can be enhanced while ensuring the phase difference.

Figure 13:
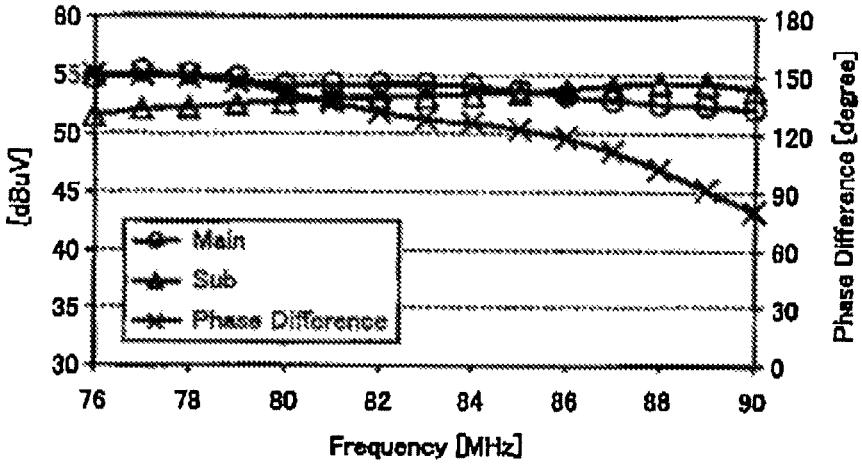
FIG. 13 is a graph showing measured data of the antenna gain and the phase difference in the glass antenna.

FIG. 13 shows data of measurements of the antenna gain and the phase difference of automobile high-frequency glass antennas which were produced by mounting the embodiment of the glass antenna shown in FIG. 6 to the backlite of an actual vehicle. The measurement conditions are identical with those of the case of FIGS. 7A to 8C.

The left ordinate in FIG. 13 indicates average values of antenna gains of the first antenna conductor (main antenna) and the second antenna conductor (sub antenna) which are measured every 1 MHz in the radiation frequency band of from 76 to 90 MHz, and the right ordinate in FIG. 13 indicates the average value which is obtained by, with respect to received waves received respectively by the first and second antenna conductors, measuring phase differences at an interval of 1° of the rotation angle at a radiation frequency of 83 MHz, and averaging absolute values of the phase differences over 360° in Azimuth direction.

The shortest distance between the center line 40 and the end portion 2*g* (or 8*g*) is indicated by x31, that between the center line 40 and the end portion 3*crg* (7*crg* or 7*brg*) is indicated by x42, and that between the center line 40 and the end portion 7*clg* (7*ag* or 7*blg*) is indicated by x43.

The gap between the antenna element 2 and the auxiliary element 8 is indicated by x51, that between the partial element 4*a* and the auxiliary element 8 is indicated by x52, that between a partial element 3*cl* (3*cr*) and the partial element 7*cl* (7*cr*) is indicated by x53, and that between the partial element 3*cl* (3*cr*) and the partial element 7*bl* (7*br*) is indicated by x54.

The antenna conductors of the glass antenna shown in FIG. 6 have the following dimensions:

xA: 843 mm
xB: 193 mm
xC: 572 mm
xD: −93 mm
x1: 150 mm
x3*a:* 193 mm
x3*b:* 150 mm
x4: 960 mm (total length of 4*a*, 4*b*, and 4*c*)
x9: 10 mm
x11: 30 mm
x13: 30 mm
x21: 93 mm
x31: 515 mm
x42: 50 mm
x43: 530 mm
x51: 80 mm
x52: 70 mm
x53: 18 mm
x54: 70 mm.

The description of the dimensions which are identical with the above-described dimensions of the antenna conductors of the glass antennas shown in FIGS. 1, 2, and 3 in the case where the data of FIGS. 7A to 8C are measured is omitted.

As shown in FIG. 13, according the glass antenna 800 having the above-described dimensions, therefore, the antenna gains of the first and second antenna conductors can be maintained at a high level while ensuring that the phase difference is about 75° or more.

Figure 15A:
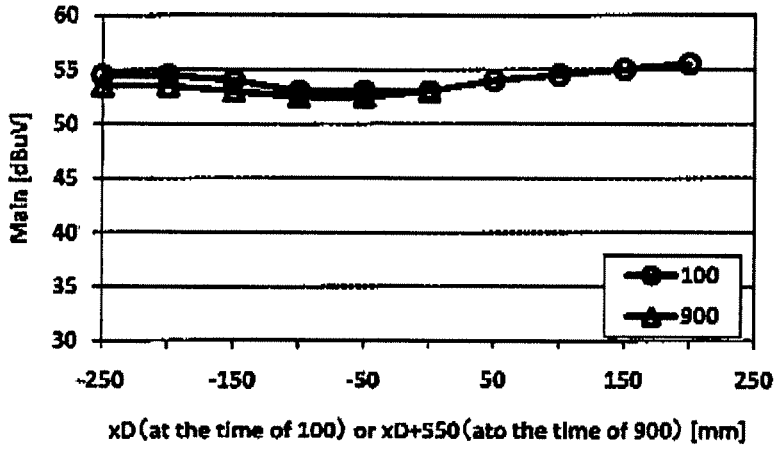
FIGS. 15A to 15C are graphs showing measured data of the antenna gain and the phase difference when a distance xD was changed.
Figure 15B:
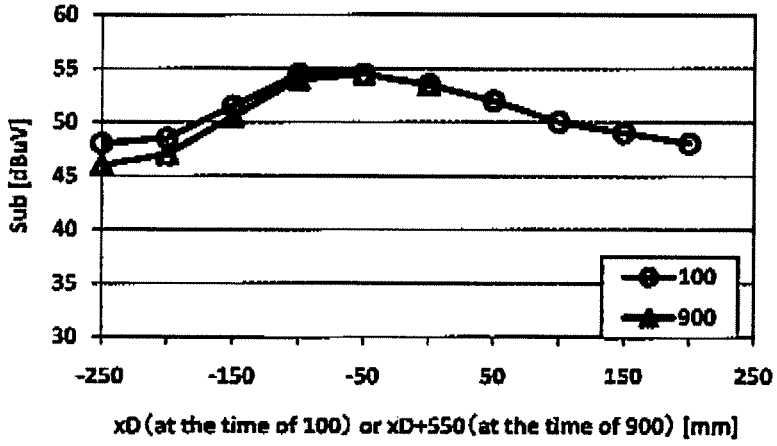
Figure 15C:
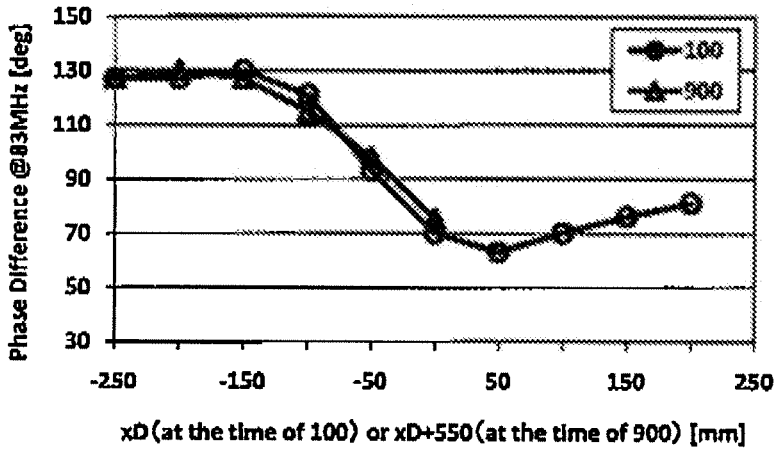

FIGS. 15A to 15C show data of measurements of the antenna gain and the phase difference in which, in automobile high-frequency glass antennas mounted to the backlites of actual vehicles embodying the glass antenna 100 shown in FIG. 1 and the glass antenna 900 shown in FIG. 14, the shortest distance xD between the end portion 4*cg* and the center line 40 was changed. The measurement conditions are identical with those of the case of FIGS. 12A to 12C.

The ordinate in FIG. 15A indicates the average value of the antenna gains of the first antenna conductor (main antenna) which are measured every 1 MHz in the radiation frequency band of from 76 to 90 MHz. The ordinate in FIG. 15B indicates the average value of the antenna gains of the second antenna conductor (sub antenna) which are measured every 1 MHz in the radiation frequency band of from 76 to 90 MHz. The ordinate in FIG. 15C indicates the average value which is obtained by, with respect to received waves received respectively by the first and second antenna conductors, measuring phase differences at an interval of 5° of the rotation angle at a radiation frequency of 83 MHz, and averaging absolute values of the phase differences over 360° in Azimuth direction.

Figure 12A:
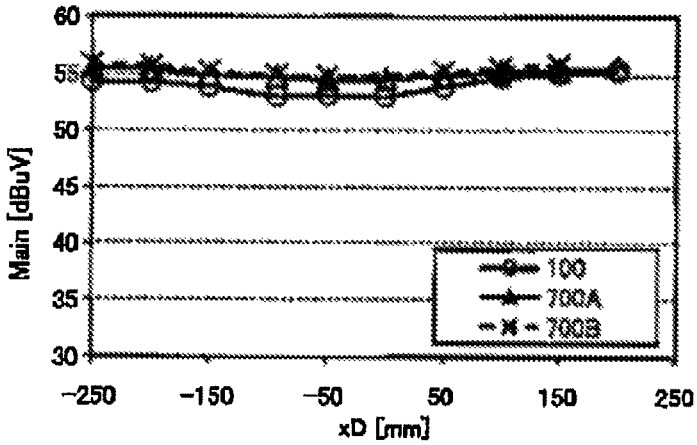
FIGS. 12A to 12C are graphs showing measured data of the antenna gain and the phase difference when the distance xD was changed.
Figure 12B:
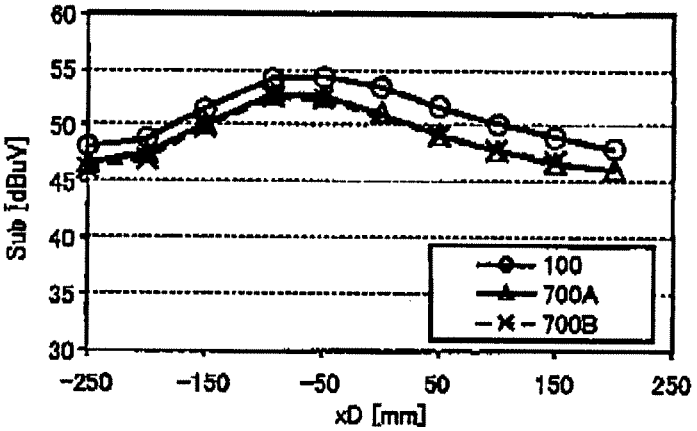
Figure 12C:
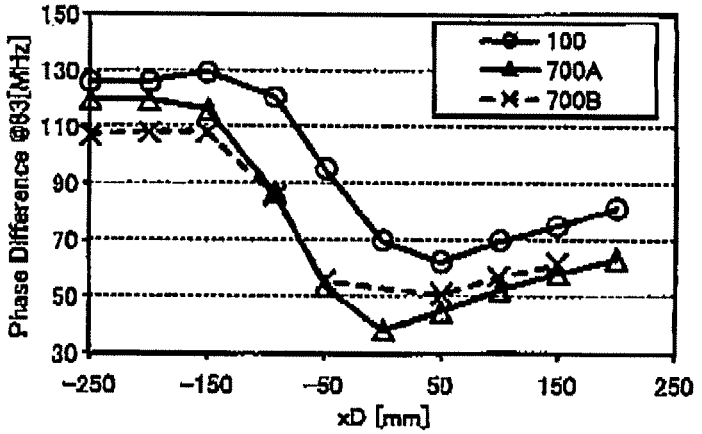

Besides, in the glass antenna 900, the abscissa axes of FIGS. 12A to 12C are corresponding to distances obtained by adding 550 mm to xD.

The dimensions of the antenna conductors of the glass antenna 100 are identical with the dimensions in the case where the data of FIGS. 12A to 12C are measured, and therefore, the descriptions of the dimensions are omitted. Further, the dimensions of the antenna conductors of the glass antenna 900 shown in FIG. 14 are identical with that of the glass antenna 100 excepting the configuration in which the connection element 9 is not provided.

As shown in FIGS. 15A to 15C, the antenna gain of the first antenna conductor (main antenna), the antenna gains of the second antenna conductor (sub antenna) and the phase difference of the glass antenna 900 have similar profiles to the glass antenna 100 when 550 mm is added to xD of the glass antenna 100. Since the distance of 550 mm is corresponding to about $(1/4)\lambda_g$ at 83 MHz that is the center frequency of the FM broadcast band (76 to 90 MHz) in Japan, the glass antenna 900 can realize effects similar to the glass antenna 100 when the conductor length corresponding to about $(1/4)\lambda_g$ is added to the antenna element 4. Namely, from the viewpoint that both the antenna gain and the phase difference are satisfied, by adjusting xD from 400 mm to 500 mm, the gains of the first and second antenna conductors can be enhanced while ensuring the phase difference.

What is claimed is:

1. A glass antenna for a vehicle, on or in a window glass including a defogger having a plurality of heater wires that run in parallel, the glass antenna comprising:

a first antenna conductor including: a first element; a second element; and a third element;

a second antenna conductor including: a fourth element;

a first feeding portion; and a second feeding portion, wherein:

the first feeding portion and the second feeding portion that are adjacent to each other in a direction that is parallel to a parallel running direction of the plurality of heater wires are disposed;

the first element is elongated from the first feeding portion in a first direction which is perpendicular to the parallel running direction, and along which the element approaches the defogger;

the second element is elongated from the first element in a second direction which is parallel to the parallel running direction, and which is directed toward the second feeding portion with respect to the first element;

the third element includes: a first partial element which is elongated from the first element in a third direction that is opposite to the second direction; a second partial element which is elongated from the first partial element in a fourth direction that is opposite to the first direction; and a third partial element which is elongated from the second partial element in a direction that is parallel to the parallel running direction;

the fourth element is elongated from the second feeding portion in the second direction, and thereafter detours an end of the second element in the second direction, on a side of the second direction to be elongated in the third direction, and the fourth element is not connected to the defogger on direct current.

2. The glass antenna according to claim 1, wherein the second element includes a first elongated element which is elongated from an end portion of the elongation in the second direction that is started from the first element, in a direction that is perpendicular to the parallel running direction.

3. The glass antenna according to claim 2, wherein
the first elongated element is elongated in a direction that is perpendicular to the parallel running direction, and thereafter further elongated in a direction that is parallel to the parallel running direction.

4. The glass antenna according to claim 1, wherein
when a wavelength in the air at a center frequency of a desired broadcast frequency band is indicated by 0, a shortening coefficient of wavelength in a glass is indicated by k (k=0.64), and g=0"k is set, a length of a conductor path that is longest among conductor paths through which the first feeding portion and an end of the elongation of the second element are connected to each other at a shortest distance is not smaller than 0.19 g and not larger than 0.33 g.

5. The glass antenna according to claim 1, wherein
a length of a conductor path that is longest among conductor paths through which the first feeding portion and an end of the elongation of the second element are connected to each other at a shortest distance is not smaller than 450 mm and not larger than 750 mm.

6. The glass antenna according to claim 1, wherein
the third element further includes a second elongated element which is connected to the third partial element, and which is elongated in a direction perpendicular to the parallel running direction.

7. The glass antenna according to claim 6, wherein
the second elongated element is elongated in the direction perpendicular to the parallel running direction, and thereafter folded back to a direction along which the second elongated element approaches the second partial element, to be elongated.

8. The glass antenna according to claim 1, wherein
when a wavelength in the air at a center frequency of a desired broadcast frequency band is indicated by 0, a shortening coefficient of wavelength in a glass is indicated by k (k=0.64), and g=0"k is set, a length of a conductor path that is longest among conductor paths through which the first feeding portion and an end of the elongation of the third element are connected to each other at a shortest distance is not smaller than 0.38 g and not larger than 0.44 g.

9. The glass antenna according to claim 1, wherein
a length of a conductor path that is longest among conductor paths through which the first feeding portion and an end of the elongation of the third element are connected to each other at a shortest distance is not smaller than 900 mm and not larger than 1,000 mm.

10. The glass antenna according to claim 1, wherein
when a wavelength in the air at a center frequency of a desired broadcast frequency band is indicated by 0, a shortening coefficient of wavelength in a glass is indicated by k (k=0.64), and g=0"k is set, a gap between the first element and the second partial element in a direction that is parallel to the parallel running direction is not larger than 0.13 g.

11. The glass antenna according to claim 1, wherein
a gap between the first element and the second partial element in a direction that is parallel to the parallel running direction is not larger than 300 mm.

12. The glass antenna according to claim 1, wherein
in a case that when an end portion of the elongation of the fourth element is located on a side of the third direction with respect to a center line of the defogger or the window glass in the parallel running direction, a positive sign is set, and when the end portion of the elongation of the fourth element is located on a side of the second direction with respect to the center line, a negative sign is set, a shortest distance from the connection point to the center line is not less than 400 mm and not more than 500 mm.

13. The glass antenna according to claim 1, wherein
the first antenna conductor includes at least a first auxiliary element which is elongated from the first element in a direction that is parallel to the parallel running direction.

14. The glass antenna according to claim 1, wherein
the first antenna conductor includes at least a second auxiliary element which is elongated from the second partial element in a direction that is parallel to the parallel running direction.

15. A window glass for a vehicle, comprising
the glass antenna according to claim 1.

* * * * *